United States Patent [19]

Gray

[11] Patent Number: 4,593,590

[45] Date of Patent: Jun. 10, 1986

[54] POWER TOOL FENCE

[76] Inventor: Harold Z. Gray, 15577 Tacony Rd., Apple Valley, Calif. 92307

[21] Appl. No.: 672,603

[22] Filed: Nov. 19, 1984

[51] Int. Cl.[4] ..... B27B 27/10

[52] U.S. Cl. ..... 83/438; 83/477.2; 83/435.2

[58] Field of Search ..... 83/438, 437, 477.2, 83/435.2, 552

[56] References Cited

U.S. PATENT DOCUMENTS

| | | | |
|---|---|---|---|
| 222,574 | 12/1879 | Constant | 83/438 |
| 245,075 | 8/1881 | Jones | 83/438 |
| 272,734 | 2/1883 | McDonald | 83/438 |
| 287,124 | 10/1883 | Hamlet | 83/438 |
| 954,192 | 4/1910 | Lambert | 83/438 |
| 2,556,548 | 6/1951 | Modderman | 83/438 |
| 2,560,996 | 7/1951 | Stone | 83/438 |

*Primary Examiner*—Donald R. Schran

*Attorney, Agent, or Firm*—Georges A. Maxwell

[57] ABSTRACT

An adjustable fence structure in combination with the work supporting table of a power tool. The fence structure is a parallogram frame structure including elongate, parallel mounting and fence rails and a pair of elongate, parallel links spaced longitudinally of, extending between and pivotally connected with said rails. The fence structure includes a locking device to releasably lock the rails and links against pivotal movement with said rails in set lateral spaced parallel relationship and which includes an elongate lock bar with one end pivoted to the fence rail and its other end portion pivotally and slidably connected with the mounting rail with the longitudinal axis of the bar angularly related to the longitudinal axes of the rails and links. The locking device includes a screw part to releasably clamp the bar in set position on the mounting rail. The fence rail slidably carries an elongate glide with a flat, vertical, work engaging flange and a portion formed to establish sliding supporting engagement with the fence rail whereby the glide is parallel with and is substantially free to shift longitudinally of the fence rail and relative to the table.

4 Claims, 11 Drawing Figures

POWER TOOL FENCE

This invention has to do with an improved adjustable power tool fence.

BACKGROUND OF THE INVENTION

In the power tool art, there are several power tools which are characterized by and/or which are oftentimes used in combination with flat, horizontal, work-supporting tables and wherein the tables are provided with straight, elongate, horizontally extending upwardly projecting work guiding and/or work stop parts which serve to orient work and to assist the operators of the tools to work across the tops of the tables and relative to the work performing elements or parts of the power tools. Those work guiding and/or work stop parts are commonly referred to as "fences".

The most familiar class of power tools with which fences of the character referred to above are commonly related are table saws. Table saws are characterized by rectangular tables with flat, horizontal, work-supporting top surfaces, vertical slot-like blade openings in the tables, electric motors mounted beneath the tables and flat, disc-shaped saw blades carried by the shafts of the motors and having upper portions projecting freely through the blade openings and upwardly from the top surfaces of the tables.

Table saws of the character referred to above are such that work can be engaged atop the tables and manually moved thereacross and relative to the blades to effect the making of desired cuts therein. In the course of using table saws, to assure the making of straight predetermined cuts in work and to prevent the work and saw blades from binding and causing serious adverse effects, the work must be carefully and accurately moved across the tables in straight lines, parallel with the radial planes of the saw blades.

To enable the work to be moved across the tables and relative to the blades of table saws in the manner set forth above, fences of the general character here concerned with and referred to above are utilized. The elongate fences are suitably mounted on the tops of the tables on lines spaced axially from and parallel with the radial planes of the saw blades and work to be cut is engaged and supported atop the tables, in advance of the saw blades and is moved into stopped engagement with the fences. Thereafter, the work is manually moved longitudinally of the fences and is advanced to and by the saw blades to effect the desired cuts therein.

The lines of cuts to be made in work varies infinitely. Accordingly, it is necessary that the lateral spacing of the fences relative to the radial planes of the saw blades must be varied and adjusted so that work is cut along desired lines. The lateral spacing or distance between the fences and the sawblades determines the "width" of the cuts to be made in the work and it is therefore the width of cuts which is determined by lateral movement and adjustment of the fences relative to the blades in table saws.

In the case of some table saws provided by the prior art, fences are not provided and the users of those saws must build their own fence structures. In such cases, the fence structures commonly consist of straight board, clamped and held in desired position atop the saw tables by C-clamps or the like. In other cases, table saws are provided with adjustable fence structures which include elongate work engaging fences which are substantially coextensive with the longitudinal extent of the tables and are parallel with the radial planes of the saw blades. Such adjustable fences are supported by cars or other suitable guide members or parts slidably carried by or engaged in longitudinally spaced transversely extending rails or grooves carried by or formed in the tables. Adjustable fence structures of the character referred to in the foregoing are such that lateral positioning of the fences relative to the saw blades can be accurately adjusted to infinitely vary the width of cut to be made in the work. In the case of such adjustable fence structures, manually operable locking means are commonly provided to releasably lock the cars (or equivalent means) in desired set position relative to the rails (or grooves) with which they are related. While many of the adjustable fence structures provided by the prior art are theoretically effective, the great majority of those structures are in fact such that they are subject to setting the fences in misalignment with their related saw blades and therefore such that they must be operated and set with great care. As a result of the foregoing, they are frequently extremely slow, time-consuming and troublesome to operate.

A major shortcoming which exists in adjustable table saw fence structures of the general character referred to above resides in the fact that they are built into their related tables in such a manner that the maximum width of cuts that can be made therewith is unduly limited. In order to overcome the foregoing limitation, the manufacturers of some table saws provide heavy and costly table saw extensions with which their adjustable fences can be related. While such saw table extensions increase the range of the width of cut that can be made, most extensions are of such limited size and extent that they seldom afford an adequately wide range of adjustment to meet the requirement and/or desires of the majority of table saw owners and operators.

Throughout the art in which table saws are used, there is a large and ever-increasing number of instances where the owners and operators of table saws construct large and expansive table saw tables to replace the original tables of their table saws or construct large and expansive saw table extensions engageable with and/or about the relatively small tables of inexpensive commercially available table saws provided by the prior art. Such large and expensive replacement saw tables or saw table extensions are commonly established of sheets of plywood or the like and are used by those who, in the normal course of using their table saws, frequently have to work with and cut full 4 ft. by 8 ft. sheets of plywood or the like and/or cut other large fabricated panel-like structures. In such instances, the fences provided with the table saws are useless and the operators of the saws must improvise and use jury-rigged type fence structures of questionable effectiveness.

While some manufacturers of table saws provided saw tables of sufficient size to conveniently handle full 4 ft. by 8 ft. plywood panels and the like, the price exacted for such tables is prohibitive for most individuals and small shops and are seldom cost-effective under the best of circumstances.

Another undesirable characteristic found to exit in the fence structures for table saws and other power tools, against which work is engaged and along which work is moved, resides in the tendency of the work to stick, catch or otherwise "hand up" on the fences and in doing so to create a multitude of problems and adverse effects too numerous to recite. While it is understood that certain special fence structures with work-engaging roller bearings or the like have been provided by the prior art to prevent the hanging up of work on the fences, to the best of may knowledge and belief, no such structures has been made which is sufficiently simple and economical to make to have attained any commercial success. Accordingly, the need for a fence structure which assures free movement of work relative thereto and which is simple and inexpensive has not been satisfied by the prior art.

OBJECTS AND FEATURES OF MY INVENTION

It is an object of my invention to provide an improved adjustable table saw fence structure that is easy, fast and convenient to operate; a fence structure which is accurate and dependable in operation; and a structure which is such that it can be easily and quickly related to most saw tables or saw table extension.

Another object of my invention is to provide an improved saw fence structure which is such that it allows for the free movement of work and prevents the sticking, catching or hanging up of work which is engaged therewith and moved relative thereto.

It is an object and feature of my invention to provide an improved parallelogram type fence structure with laterally spaced elongate, parallel work-engaging fence and table engaging mounting rails, parallel links spaced longitudinally of, extending between and pivotally connected with the rails and a convenient and fast-to-operate manually operable lock mechanism engaged with and extending between the rails to releasably set the rails in desired lateral spaced parallel relationship.

Another object and feature of my invention is to provide an improved fence structure of the general character referred to above including novel mounting structure for releasably securing the mounting rail to a related saw table.

Yet another object and feature of my invention is to provide an improved fence structure of the general character referred to wherein the fence rail includes novel structure allowing for free movement of work engaged therewith relative to a related saw table and which allows for desired longitudinal positioning of the fence rail relative to the saw table.

The foregoing and other features of my invention will be fully understood from the following detailed description of typical preferred forms and embodiment of my invention, throughout which description reference is made to the accompanying drawings.

DESCRIPTION OF THE DRAWINGS

FIG. 7 is an enlarged view taken substantially as indicated by line 7—7 on FIG. 2;

DESCRIPTION OF THE INVENTION

Figure 1:
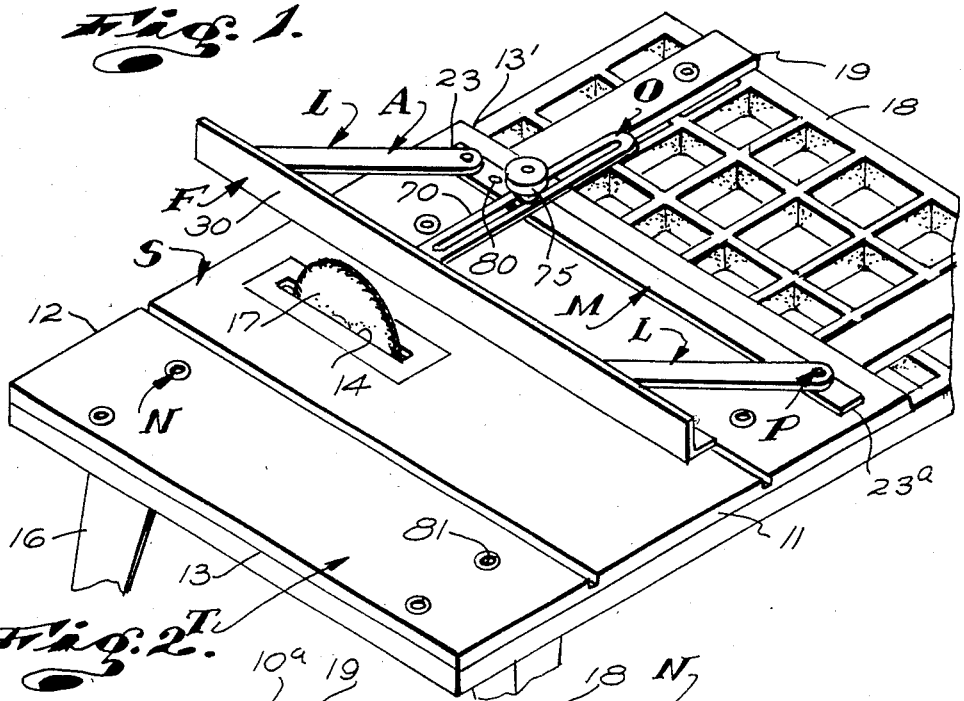
FIG. 1 is an isometric view of a table saw with my new fence structure related to it.
Figure 2:
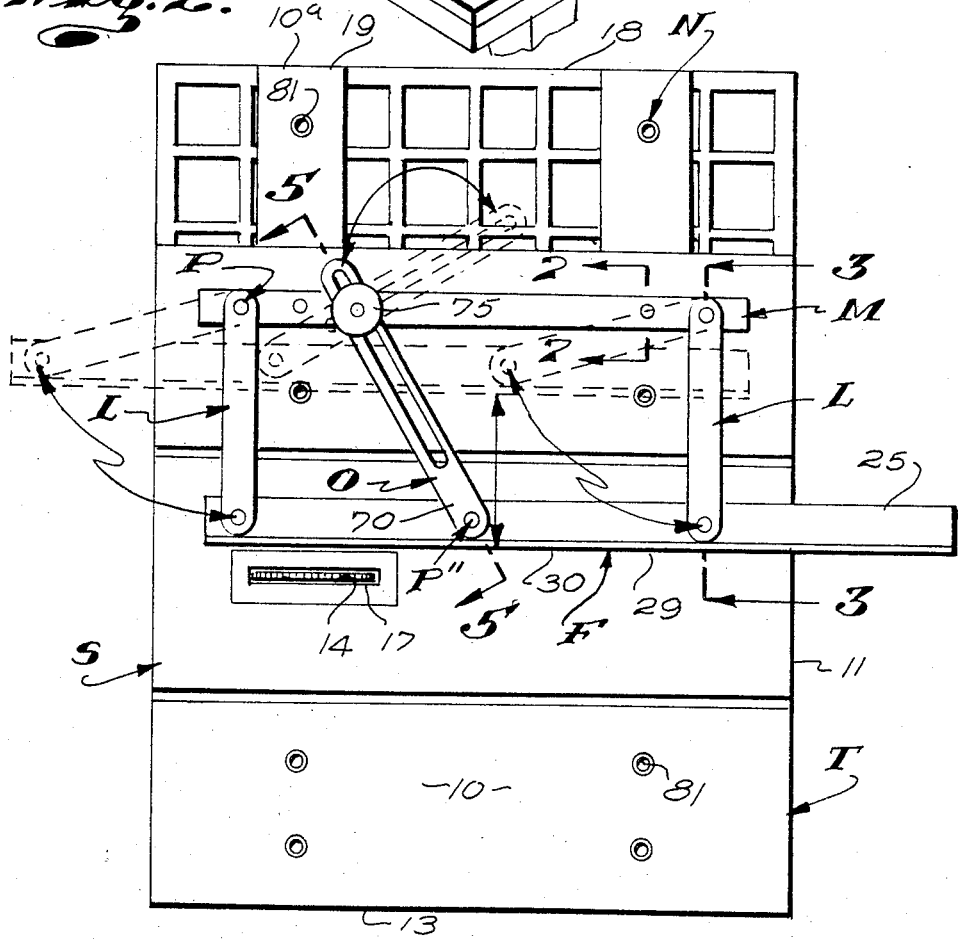
FIG. 2 is a top view of the structure shown on FIG. 1.
Figure 3:
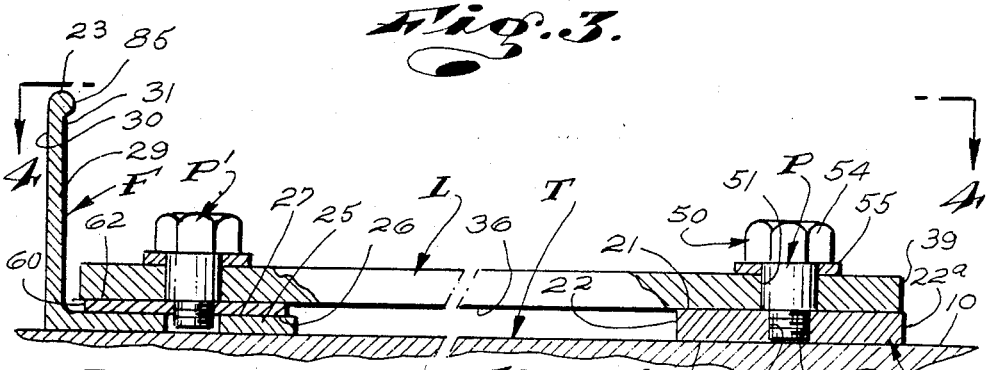
FIG. 3 is an enlarged view taken substantially as indicated by line 3—3 on FIG. 2.
Figure 4:
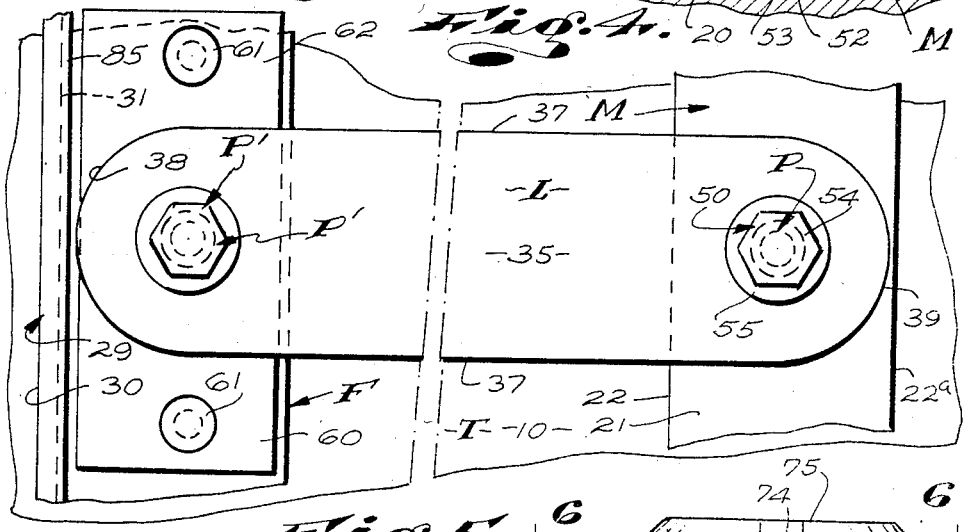
FIG. 4 is a view taken substantially as indicated by line 4—4 on FIG. 3.
Figure 5:
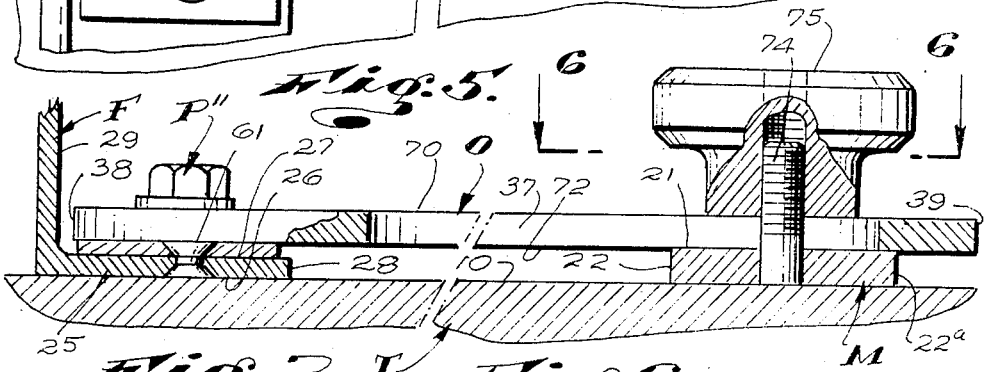
FIG. 5 is an enlarged view taken substantially as indicated by line 5—5 on FIG. 2.
Figure 2:
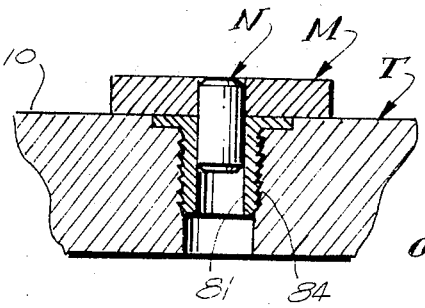
Figure 6:
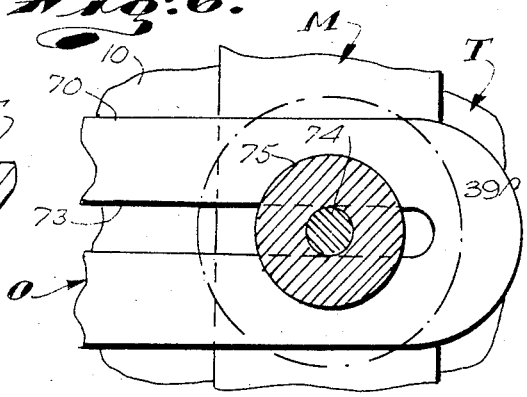
FIG. 6 is a view taken substantially as indicated by line 6—6 on FIG. 5.

In FIGS. 1 and 2 of the drawings, I have shown my new adjustable fence structure A engaged on the top of the table T of a common table saw structure S. The table T is a rectangular part with a flat, horizontal top surface 10, oppositely disposed front and rear edges 11 and 12 and oppositely disposed side edges 13 and 13'. The table T is provided with an elongate, slot-like, vertical saw blade opening 14. The longitudinal axis of the opening 14 is normal to the front and rear edges 11 and 12 and is parallel with the longitudinal axis of the table. The opening 14 is shown spaced substantially midway between the edges 13 and 13' and is closer to the front edge 12 than to the rear edge 11 of the table.

It is to be noted that the location of the opening 14 in the table T is not critical and is often quite different in different makes and models of table saws.

In the saw structure illustrated, the table T is or can be of any size and for the purpose of this disclosure is shown supported on an underlying frame part 15 with groundengaging legs 16. The table T can be made of plywood, particle board or any other suitable material, without departing from or affecting the novelty of my invention.

In addition to the foregoing, the saw structure S is shown as including a disc-shaped saw blade 17 freely engaged in and having an upper portion projecting upwardly from the opening 14 and from the top surface 10 of the table. The blade 17 is carried by a shaft (not shown) below the table T, which shaft is suitably related to and rotatably driven by a prime mover, such as an electric motor (not shown) suitably mounted in the saw structure below the table. The central rotary axis of the blade 17 is securely set relative to the longitudinal and lateral axes of the table T and so that its radial plane is parallel with the longitudinal axis of the table. In practice, while efforts are exercised to set the blades of table saws parallel with the longitudinal axes of their related tables, it is not infrequent that such a relationship is not achieved.

Further, in practice, the saw carrying shafts and drive means for table saws are generally adjustable vertically relative to the tables of the saws so that the vertical positioning of the blades can be adjusted and set to make cuts of different depths in work which is engaged upon and moves across the table tops and relative to the blades. Since the structures and means by which vertical positioning and/or adjustment of table saw blades vary greatly in practice and since such means in no way affects the novelty of my invention, illustration and description of a such a means need not and will not be presented.

Finally, in addition to the foregoing, the table saw structure S illustrated in the drawings includes a table frame extension 18 at one side of the table T and frame part 15. The extension 18 is shown as a rectangular grate like structure with a flat, horizontal top surface parallel with the top plane of the frame part 15 and is suitably and securely attached to said frame part 15. The extension 18 is adopted to have fixed to it and to support work-supporting panels or the like with top surfaces which occur on a common plane with the top surface 10 of the table T. In the case illustrated, the extension 18 is provided with and carries a pair of longitudinally spaced, laterally extending extensions 19 which extend laterally outward from the side 13' of the table T and which have top surfaces 10A which are on a common plane with the top surface 10 of the table T.

It is to be particularly noted that the whole of the table structure illustrated in the drawings and briefly described in the foregoing is only illustrative of one typical type or class of table structure with which my new adjustable fence structure can be advantageously related and is not intended to limit or restrict the scope of my invention.

In its most simple or basic form, my new adjustable fence structure A consists of an elongate, rectilinear, parallelogram frame-like structure, including a pair of elongate, laterally spaced, parallel, longitudinally extending rails F and M, a pair of elongate, longitudinally spaced, parallel, laterally extending links L extending between and pivotally connected with related end portions of the rails F and M, manually operable operating means O engaged with and extending between the rails F and M to selectively set the rails in adjusted lateral spaced relationship and mounting means N releasably mounting the structure in predetermined positions on and relative to the top surface 10 of the saw table T with which it is related.

The rail M is a mounting rail and is preferably a straight, elongate, horizontal metal bar, rectangular in cross-section and such that it defines a flat, horizontal, downwardly disposed table top engaging surface 20 and a flat, horizontal top surface 21. The mounting rail can and is shown as having straight, parallel inner and outer side edges 22 and 22A and front and rear ends 23 and 23A.

The mounting rail M is of substantial longitudinal extent and can be slightly greater or less in longitudinal extent than the longitudinal extent of the table T, as desired or as circumstances require. In my manufactured embodiment of the invention, the rail M is established of 1"×½" aluminum bar stock and is about 32" long.

The rail F is a work-engaging fence rail and is established of a length of metal angle stock. The rail F has a flat, longitudinally extending, horizontal lower flange 25 with a flat, horizontal, table top engaging bottom surface 26, a horizontal top surface 27, an inner edge 28, and has flat, longitudinally extending, vertical outer flange 29 with a flat, laterally outwardly disposed work-engaging surface 30, a flat, laterally inwardly disposed inner surface and a top edge 32.

The fence rail F is preferably substantially longer than the mounting rail M. In my manufactured embodiment of the invention, the rail R is established of 2"×2" extruded aluminum angle stock and is about 40" long.

The links L are alike and are preferably established of lengths of the same metal bar stock of the mounting rails M and flat, top and bottom surfaces 35 and 36, parallel sides 37 and normally substantially laterally inwardly and outwardly disposed opposite inner and outer radiused ends 38 and 39.

In my manufactured embodiment of the invention, the links L are 14" long.

The pair of links L are spaced longitudinally of and extend between their related forward and rear end portions of the rails R and M, as clearly shown in FIGS. 1 and 2 of the drawings.

The outer end portions of the links L overlie the mounting rail M with their bottom surfaces 36 in flat, sliding bearing engagement with the top surface 21 of the rail M. The outer end parts of the links L are pivotally connected to and with the rail M by pivot pins P. The pivot pins P are established by large vertically extending central cylindrical pin portions of headed shoulder bolts 50. The pin portions of the bolts 50 are engaged through vertical bearing openings 51 in the links. The bolts 50 have lower threaded shank portions 52, smaller in diameter than the pin portions and which are engaged in vertical threaded openings 53 in the mounting rail M. The bolts 50 have enlarged tool-engaging heads 54 at the upper ends of their pin portions. The heads are accessible at the tops of the links. Axially resilient washers 55 are engaged about the pin portions and between the bolt heads 54 and the top surfaces 35 of the links to yieldingly maintain the links L in snug uniform bearing engagement with the rail M.

The inner end portions of the links overlie the flange 25 of the fence rail F with their bottom surfaces opposing the top surface 27 of said flange.

In practice, if the flange 25 is the same in vertical extent as the rail M, the inner ends of the links could and would be pivotally connected thereto in the same manner that the outer ends of the links are connected with the mounting rail M. However, in practice and for good and practical reasons, the flange 25 of the rail R is thin and substantially less in vertical extent than is the mounting rail M. Accordingly and so that the links are set and maintained horizontally disposed and to provide secure mounting between the links and the rail R, I provide the rail with flat, horizontal, suitably apertured, hardened steel mounting plates 60 which are fixed to the top surface of the flange 25 as by means of flush rivet fasteners 61. The plates 60 have flat, horizontal top bearing surfaces 62 which occur on a common horizontal plane with the top surface 21 of the rail M and on which the inner portions of the bottom surfaces 36 of the links L are supported. The plates 60 have threaded openings 63 corresponding to the openings 33 in the rail M and the inner portions of the links L are pivotally coupled or connected with the plates 60 and with the rail R by pivot pins P' which are identical with the pins P and which are engaged with and related to the plates 60 and the links L in the same manner that the pins P are engaged with and related to the rail M and the links L.

The pair of rails M and R are parallel and the pair of links L are parallel. Accordingly, the pivotally connected related pairs of parallel links and parallel rail establish a parallelogram which is such that upon relative lateral shifting of the rails M and R, the parallel links pivot or move between and relative to the rails to maintain said rails in parallel relationship at all times.

The operating means O includes an elongate locking bar 70 which can be and is preferably established of a length of the same bar stock as the rail M and the links L. The locking bar has flat, horizontal top and bottom surfaces 71 and 72, laterally spaced oppositely disposed sides and inner and outer ends. The inner end portion of the locking bar is pivotally connected to the flange 25 of the fence rail R by a pivot pin coupling structure P" which is identical with the pivot pin structure which is utilized to couple the links L to the rail R and which is clearly shown in the drawings and has been described in the foregoing. The outer portion of the bar 70 extends across the top of the mounting rail M between the ends thereof in sliding engagement therewith and extends freely outward therefrom. The outer end portion of the bar 70 is provided with a central longitudinally extending, vertically extending slot 73 in and through which an elongate, vertically extending threaded stud 74, mounted in and projecting upwardly from the mounting rail M, is slidably engaged. The stud 74 projects freely upwardly from the bar 70 and threadedly carries a manually engageable clamping nut 75. The clamping nut 75 is in the form of a manually engageable handle or knob. The locking nut 75 is manually turned and advanced on the stud 74, into and out of tight engagement with the bar 70 to selectively set and to release said bar in and from tight, clamped relationship with the mounting rail M.

The pivotal coupling means P″ at and between the fence rail F and the inner end of the lock bar 70 and the stud 74 on the mounting rail M, engaged through the slot 72 in the bar 70, are spaced dissimilar distances between the pivotal axes of their related inner and outer ends of the links whereby the bar 70 is out of parallel relationship with the links or is angularly related thereto at all times. Accordingly, when the bar 70 is clamped tight on and with the mounting rail M, it cooperates with the rails F and M and with each of the links L to establish what is in effect two non-parallel quadrangles with a common adjacent side (established by the bar 70) and a structure wherein the rails F and M are securely releasably locked in parallel relationship. Upon release of the means O, the links L are free to pivot relative to the rails F and M and the rails can be manually moved laterally in parallel relationship with each other, to any desired position within the range of movement afforded by the structure and can be set in that position by simply tightening the nut 75.

In practice and in the case illustrated, the inner end of the bar 70 is pivotally coupled to the rail F substantially midway between the inner ends of the links L and the stud 74 for the outer end portion of the bar is positioned forward in the framework of the parallelogram forward of the inner end of the bar and in close proximity to the forward link L. With such a relationship of parts when the structure is operated to adjust the spacing between the parallel rails F and M, the outer end of the bar 70 swings through a parabolic path, outward of the rail M, from the stud 74 toward the central portion of the rail M, as clearly shown in FIG. 2 of the drawings. It will be apparent that with the above noted relationship of parts, the bar will not move into interferring engagement with the links L and is least likely to become an obstruction during normal anticipated use at the construction.

The mounting means N that I provide functions to mount the mounting rail M on the top surface 10 of the table T in predetermined laterally spaced, parallel relationship with the radial plane of the saw blade 17. The means N includes a pair of longitudinally spaced vertical mounting pins 80 fixed to and depending from the mounting rail M and vertically upwardly opening pairs of pin-receiving socket openings 81 in the table, in register with and frictionally slidably receiving the mounting pins 80. The pins 80 are short, vertically extending dowl pins established of cylindrical steel drill rod and have upper end portions press-fitted into vertical openings in the rail M. The socket openings 81 can be simply drilled in the table T, from the top thereof, if the material of which the table T is established is suitably tough and durable. In practice, I have determined that in most instances, the materials of which saw tables are established are not suitable for establishing the openings 81 and I have therefore resorted to the provision and use of accurately made hardened steel bushing sleeves 84 which define the necessary openings 81 and which can be effectively and suitably set in large openings drilled in the table T to cooperatively receive them. The type or class of bushing which I utilize is clearly shown in FIG. 7 of the drawings.

With the means N that I provide, it will be apparent that the mounting rail M and therefore the whole of the structure A is effectively held in position on the top surface 10 of the table T against horizontal displacement. Further, the structure A is mounted on the table in such a manner that if desired or if circumstances require, the structure A can be removed from engagement with the table T by simply manually lifting and drawing the pins 80 from engagement in the openings 81.

In practice, while the range of lateral adjustment of the rails F and M is substantial, that range of adjustment is not likely to be adequate in many situations. Accordingly, in furtherance of and in carrying out my invention, the table T is provided with two or more laterally spaced pairs of mounting pin receiving socket openings 81 spaced laterally outwardly from one or both sides of the radial plane of the saw blade 17. The adjacent pairs of openings 8; are spaced laterally apart a distance slightly less than the maximum range of lateral adjustment afforded by the fence structure A. With such a combination and relationship of parts, by moving the fence structure A laterally inwardly or outwardly from engagement with one to another pair of openings 81, the range of adjustment of my fence structure on the table T and relative to the saw blade 17 is substantially infinite.

In furtherance of the above and as shown in FIGS. 1 and 2 of the drawings, pairs of socket openings 81 can be provided in most table saw extensions 19, thereby extending the use of my fence structure to such extensions.

In practice, locating the first or innermost set or pair of pin receiving openings 81 in the table T and relative to the saw blade 17 is easily established by first setting the fence rail F in flat parallel bearing engagement with the side of the saw blade 17, moving the mounting rail M laterally outward to or close to its outermost position relative to the rail F and carefully marking those points where the mounting pins engage the table top, where the openings 81 must be established. Subsequent outer adjacent pairs of openings 81 are more easily established by reversing or turning the structure A around, engaging the pins 80 in each last established pair of openings and using the rail F as a straight edge to scribe the line on which the next pair of openings should be established. Thereafter the longitudinal positioning of the pairs of openings on the scribed lines can be marked by means of a ruler or the like.

In practice and as best shown in FIG. 2 of the drawings, the forward end of the fence rail F (at the right-hand side of FIG. 2) is extended longitudinally forwardly so that the lead portion of the fence rail F, in advance or forward of the saw blade, is substantial and is possibly greater than is required when the rails F and M are spaced laterally apart a maximum extent and the rail F is in its forwardmost position. However, when the rails are moved into minimum spaced parallel relationship with the mounting rail F in its rearmost position, the forward lead portion of the fence rail F, forward or in advance of the saw blade 17, remains substantial and adequate to serve its intended function. It will be noted that if the fence rail F was not extended in the manner set forth above, the forward end portion of the fence rail, forward of the saw blade 17, would be insufficient to properly guide a piece of work relative to the blade 17.

Figure 8:
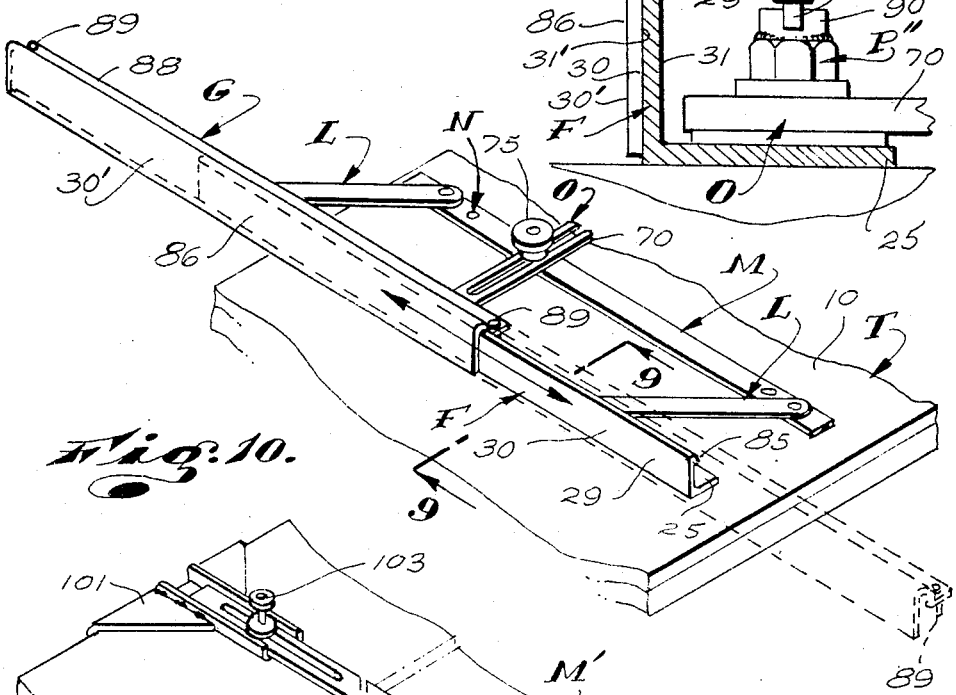
FIG. 8 is an isometric view of other embodiments of my invention.
Figure 9:
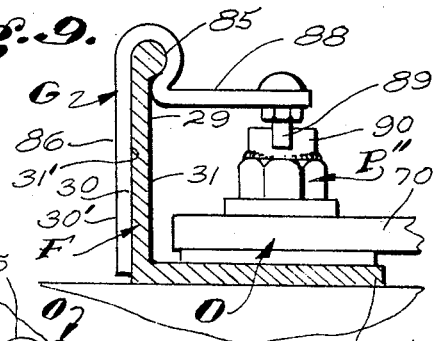
FIG. 9 is an enlarged sectional view taken on line 9—9 on FIG. 8.

The fence structure thus far described and illustrated in FIGS. 1 through 6 of the drawings is the basic fence structure of my invention and is that structure with which other novel features of my invention are incorporated. In addition to the foregoing fence structure and in furtherance of my invention, the fence rail F, as shown in FIGS. 8 and 9 of the drawings, includes an elongate work-engaging glide G slidably engaged on the vertical flange 29 of the rail and freely slidable longitudinally thereof. The glide G serves two special functions. First, the glide is such that it can be moved longitudinally of the rail F and longitudinally of the table T to position the glide relative to the table and to the saw blade 17, as desired, and to adjust or compensate for longitudinal displacement of the rail F brought about by adjusting the fence structure; and second, allows for free longitudinally movement of work relative to the rail F when that work is such that it would likely stick or otherwise hand up on the rail F.

In the form of the invention illustrated, the flange 29 of the fence rail F is formed with a laterally inwardly projecting bead 85 along its upper edge. The glide G is an elongate formed metal part which is shown as being a modified R-shape in cross-section. The glide G can vary in longitudinal extent and is preferably substantially longer than the rail F. The glide G has a flat, vertical, longitudinally extending outer flange 86 with an outer work-engaging surface 30' and an inner surface 31'. The inner surface 31' is in sliding supported engagment with the outer surface 30 of the flange 29. The flange 86 is substantially coextensive in vertical extent with the flange 29 and has a lower edge 87 which occurs in running clearance above the top of the table T. The top of the glide is formed with an upwardly, outwardly, downwardly and inwardly recurvant upper edge portion which is engaged about the beaded upper edge of the flange 29 in sliding supported engagement therewith and in which said beaded portion of the flange 29 is captively engaged. The glide next includes a flat, horizontal inner flange 88 of limited lateral extent which projects laterally inward from the inner lowermost portion of said upper edge portion 87.

The glide is made of a material or is provided with a coating which has a very low coefficient of friction with the material surface with a surface coating on the rail 29, whereby the glide G slides and shifts easily longitudinally of the flange 29. In my manufactured embodiment of the invention, the glide G and the rail R are aluminum parts with annodized surfaces which afford little frictional resistance to relative longitudinal shifting of those parts.

With the form of glide G shown, it is possible to manually move the glide to any position longitudinally of the rail F and atop the table T prior to moving a piece of work into engagement therewith. Thereafter, upon manually moving the work into engagement with the saw blade 17, the glide is free to move smoothly and freely relative to the rail and to move the work relative to the fence rail F without the likelihood of the work hanging up.

In furtherance of my invention and in the preferred carrying out thereof, stop pins 90, in the form of screws, are engaged through the ends of the flange 88 to depend therefrom and to establish stopped engagement with an upwardly projecting stop 91 mounted centrally of the rail F. The stop 90 is shown as a flat plate-like stop tab carried by and projecting up from the head 45 on the pivot pin P'' for the lock bar 70.

The pins 90 limit excessive longitudinal shifting and/or displacement of the glide on and relative to the rail F. If the movement of the glide G is less than is required to move a piece of work by the saw blade 17, after the glide is stopped by the above noted stop means, the work must thereafter be moved relative to the glide, as in the case of a common saw fence. Accordingly, while the maximum travel of the glide G is limited, the length of the glide is substantial and that travel which is afforded thereby can be made more than adequate for the handling of the majority of cutting operations likely to be performed.

Figure 10:
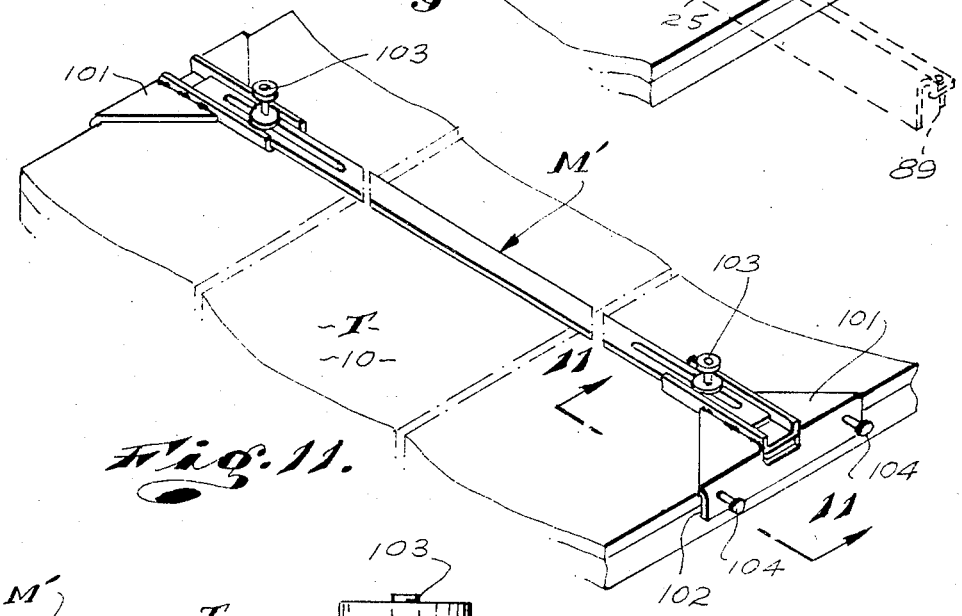
FIG. 10 is an isometric view of yet another embodiment of the invention.
Figure 11:
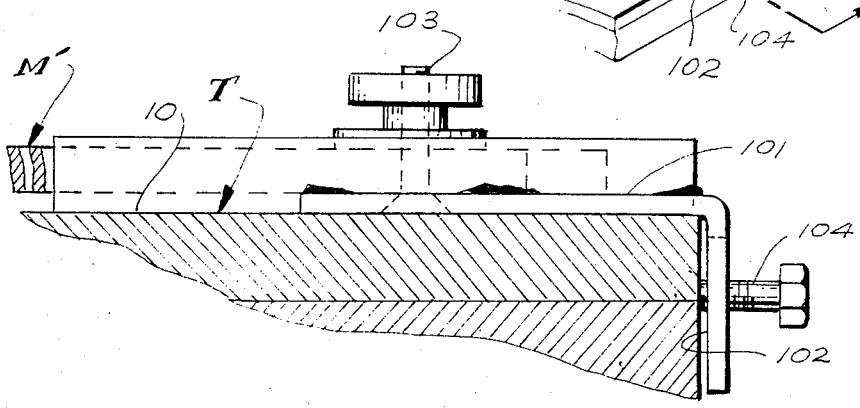
FIG. 11 is an enlarged sectional view taken on line 11—11 on FIG. 10.

In another embodiment of my invention and as shown in FIGS. 10 and 11 of the drawings, the mounting rail M' is not provided with the above noted pins 80 and the table is not provided with the above noted pin-receiving openings 81. Instead of the pins 80 and openings 81, the rail M' is provided with slotted extensions 100 at its opposite ends. The extensions 100 slidably carry table edge engaging T-heads 101. The T-heads have straight edges 102 at right angle to the longitudinal axis of the rail M'. The edges 102 establish flat aligned engagement with opposing edges of the table T. The t-heads have extension receiving channels and carry extension engaging lock screws 103 to lock the T-heads on the extensions when they are urged into aligned engagement with their related edges of the table. Further, the T-heads carry a pair of laterally spaced longitudinally shiftable, horizontal adjusting screws 104 to engage their related edges of the table. By adjusting the screws 104, the rail M can be effectively aligned relative to the blade 17. Further, the screws 104 lock the T-heads on or with the table T.

With the above noted and described adjustable rail mounting structure, it will be apparent that the mounting rail M' can be slid laterally of the table T and set in any desired position relative thereto by urging the T-heads at the ends thereof into snug engagement with the edges of the table T and by tightening the screws 103. Thereafter, the rails M' can be aligned with the blade 107 and/or with the longitudinal axis of the table T and the T-heads can be set on and with the table by operation of the screws 104.

Having described only typical preferred forms and embodiments of my invention, I do not wish to be limited to the specific details herein set forth but wish to reserve to myself any modifications and/or variations that might appear to those skilled in the art and which fall within the scope of the following claims:

Having described my invention, I claim:

1. An adjustable fence structure in combination with a power tool work table having a flat, horizontal top work supporting surface, forwardly and rearwardly disposed front and rear edges, oppositely disposed inner and outer side edges and longitudinal and lateral axes, said fence structure includes an elongate mounting rail, mounting means spaced longitudinally of the mounting rail and engaging said table to releasably secure the mounting rail on said supporting surface parallel with said longitudinal axis thereof, an elongate fence rail, positioned laterally inward of the mounting rail and having a laterally outwardly disposed vertical inner surface and a flat bottom surface in sliding supported engagement on said support surface, elongate front and rear links with inner and outer ends, the links are equal in longitudinal extent are spaced longitudinally of the rails and are in spaced parallel relationship with each other, coupling means pivotally coupling the inner and outer ends of the links to related front and rear portions of said rails with the longitudinal spacing of the coupling means at the inner and outer ends of the links spaced equidistant, lock means releasably locking the rails and the links against relative pivotal movement with said rails in set lateral spaced parallel relationship and including an elongate bar with inner and outer ends, coupling means pivotally coupling the inner end of the bar to the fence rail in spaced relationship between the inner ends of the links and screw means releasably securing the outer end portion of the bar to the mounting rail at a position spaced between the outer ends of the links with the axis of the bar angularly related to the longitudinal axes of the links and rails, said fence rail has a longitudinally extending vertical inner flange with a longitudinally extending upper edge and an elongate glide with a flat, vertical inner work-engaging flange in supported engagement with the inner surface of the fence rail and a longitudinally extending laterally inwardly and downwardly formed upper edge portion in sliding supported hooked engagement over the upper edge of the inner flange and shiftable longitudinally relative thereto.

2. The combination set forth in claim 1 wherein the mounting means includes a plurality of longitudinally spaced vertical pins carried by and depending from the mounting rail and a plurality of sets of vertically upwardly opening pin-receiving openings in the table on laterally spaced parallel lines in the table which are parallel with the longitudinal axis thereof, said pins are selectively slidably engaged in each set of openings.

3. The combination set forth in claim 1 wherein the mounting means includes front and rear T-heads with laterally extending table engaging edges opposing the front and rear edges of the table, a pair of laterally spaced set screws on horizontal longitudinally extending axes carried by the heads at said table engaging edges and engaged with related edges of the table, elongate leg portions on the heads on an axis parallel with the longitudinal axis of the mounting rail and slidable longitudinally of related end portions of the mounting rail and set screws releasably securing said elongate leg portions of the heads in set position longitudinally of the mounting rail. pg,28

4. The combination set forth in claim 1 wherein the fence rail has a longitudinally extending vertical inner flange with a longitudinally extending upper edge and an elongate glide with a flat, vertical inner work-engaging flange in supported engagment with the inner surface of the fence rail and a longitudinally extending laterally inwardly and downwardly formed upper edge portion in supporting hooked engagement over the upper edge of the inner flange, and slidable longitudinally relative thereto a first stop part on the fence rail substantially intermediate the ends thereof and a pair of longitudinally spaced second stop parts at opposite ends of the glide and movable into and out of stopped engagement with the first stop part upon longitudinal shifting of the glide relative to the fence rail.

* * * * *